US008419143B2

(12) United States Patent
Shin et al.

(10) Patent No.: US 8,419,143 B2
(45) Date of Patent: Apr. 16, 2013

(54) STRUCTURE FOR MODIFYING HEIGHT OF SHELF AND REFRIGERATOR HAVING THE SAME

(75) Inventors: Jeong-ho Shin, Changwon-Si (KR); Byeong-gyu Kang, Changwon-Si (KR); Jae-youl Lee, Changwon-Si (KR); Ki-hoon Song, Changwon-Si (KR)

(73) Assignee: LG Electronics Inc., Seoul (KR)

( * ) Notice: Subject to any disclaimer, the term of this patent is extended or adjusted under 35 U.S.C. 154(b) by 161 days.

(21) Appl. No.: 12/596,632

(22) PCT Filed: Apr. 18, 2008

(86) PCT No.: PCT/KR2008/002199

§ 371 (c)(1),
(2), (4) Date: Oct. 19, 2009

(87) PCT Pub. No.: WO2008/130150

PCT Pub. Date: Oct. 30, 2008

(65) Prior Publication Data

US 2010/0133970 A1 Jun. 3, 2010

(30) Foreign Application Priority Data

Apr. 20, 2007 (KR) ..... 10-2007-0038716

(51) Int. Cl.
*A47B 96/04* (2006.01)

(52) U.S. Cl.
USPC ..... 312/408

(58) Field of Classification Search ..... 312/408, 312/306, 405; 108/144.11–147.22
See application file for complete search history.

(56) References Cited

U.S. PATENT DOCUMENTS

| | | | | | |
|---|---|---|---|---|---|
| 716,852 | A | * | 12/1902 | Baker | 248/244 |
| 1,920,452 | A | * | 8/1933 | Wagner | 108/32 |
| 2,056,078 | A | | 9/1936 | Slater | |
| 3,356,328 | A | | 12/1967 | Sachau | |
| 3,885,846 | A | | 5/1975 | Chuang et al. | |
| 4,250,815 | A | * | 2/1981 | Swanson | 108/108 |
| 5,325,792 | A | * | 7/1994 | Mulloy | 108/28 |
| 5,354,027 | A | * | 10/1994 | Cox | 248/292.14 |
| 6,065,821 | A | | 5/2000 | Anderson et al. | |
| 2004/0255607 | A1 | | 12/2004 | Barmann et al. | |

FOREIGN PATENT DOCUMENTS

| | | | |
|---|---|---|---|
| CN | 1648554 | A | 8/2005 |
| CN | 1648581 | A | 8/2005 |
| DE | 1 298 253 | B | 6/1969 |
| DE | 92 17 491 | U1 | 2/1993 |
| EP | 0 040 180 | A1 | 11/1981 |
| KR | 1997-0011759 | A | 3/1997 |
| KR | 97-14663 | U | 4/1997 |
| KR | 10-2004-0070000 | A | 8/2004 |
| KR | 10-2006-0077404 | A | 7/2008 |
| WO | WO-03/023301 | A1 | 3/2003 |

* cited by examiner

*Primary Examiner* — Janet M Wilkens
*Assistant Examiner* — Timothy M Ayres
(74) *Attorney, Agent, or Firm* — Birch, Stewart, Kolasch & Birch, LLP

(57) ABSTRACT

The present invention relates to a shelf and a refrigerator, and more particularly, to a shelf height re-setting structure which enables convenient setting of a shelf without removing food from the shelf, and a refrigerator having the same. For this, the present invention provides a shelf height re-setting structure including a rail having height adjusting paths repeated in a vertical direction each with a slope and release and setting paths connected between adjacent height adjusting paths, and setting means secured to the shelf so as to be movable along the height adjusting paths and release and setting paths for selecting a height of the shelf, and a refrigerator with the same.

19 Claims, 4 Drawing Sheets

STRUCTURE FOR MODIFYING HEIGHT OF SHELF AND REFRIGERATOR HAVING THE SAME

TECHNICAL FIELD

The present invention relates to a shelf and a refrigerator, and more particularly, to a shelf height re-setting structure which enables downward safe translation of a shelf without sudden downward movement, and a refrigerator having the same.

BACKGROUND ART

In typical related art shelf height re-setting structures in a refrigerator, there are a type in which food is placed on each of stages formed along opposite sides of the refrigerator, and a type in which cantilever type of shelves are overhung from holes in a rear wall of the refrigerator.

In the stage type shelf height re-setting structure, the stage supports the shelf on undersides of opposite edges of the shelf and, if it is intended to re-set a height of the shelf it is required to remove the shelf from the refrigerator and put the shelf back on the stage at a different height the user desires.

In the meantime, referring to FIGS. 6 to 8, the cantilever type shelf height re-setting structure is provided with a rail 1 fixed to the rear wall of the refrigerator having a plurality of pass through holes 2 formed at regular intervals in a vertical direction, and the shelf 3 having a rear edge with a hook 4 for hooking at the pass through hole 2 and a supporting bar 5 to be in close contact with a front of the rail 1 for limiting downward movement of the shelf 3.

According to above structure, if it is intended to translate the shelf 3 having the food placed thereon, the cantilever type shelf 3 is required to remove the food from the shelf 3, to separate the hook 4 from the pass through hole 2 in the rail 1, and to hook the hook 4 at the pass through hole 2 at a desired height, again.

That is, while the stage type enables to arrange the shelves at locations of the stages, though the cantilever type enables to secure the shelf 3 at each of the pass through holes, providing a more flexible selection than the stage type, the cantilever type requires a substantial amount of efforts in removal and securing the stage, again. This can be difficult job to do for homemakers.

Moreover, since both types require removal of food from the shelf for re-setting height of the shelf a height re-setting of the shelf is not possible every time occasion calls, ailing effective utilization of a refrigerator space.

DISCLOSURE OF INVENTION

Technical Problem

In conclusion, the stage type is disadvantageous in that the shelf can not be positioned at various heights, and the cantilever type is disadvantageous in that, not only cumbersome work of food removal is required for the height re-setting, but also much effort is required for mounting the shelf again after the shelf is removed from the refrigerator even though a desired height of the shelf is available.

Technical Solution

To solve the problems, an object of the present invention is to provide a shelf height re-setting structure which enables quick height change of the shelf every time the occasion calls without removal of the food from the shelf and easy mounting of the shelf at a desired height for effective utilization of a refrigerator space, and a refrigerator therewith.

To achieve these objects and other advantages and in accordance with the purpose of the invention, as embodied and broadly described herein, a shelf height re-setting structure includes a rail having height adjusting paths repeated in a vertical direction each with a slope and release and setting paths connected between adjacent height adjusting paths, and setting means secured to the shelf so as to be movable along the height adjusting paths and release and setting paths for selecting a height of the shelf.

The height adjusting paths are constructed of guides each having a projection and a recess to form the slope, and the release and setting paths are horizontal.

The release and setting path forms a supporter for setting a position of the setting means, and the structure further includes an elastic member for providing restoring force for securing the setting means to the supporter.

In the meantime, the supporters have top surfaces projected horizontally at regular intervals, and the supporter is sloped starting from the top surface to a lower side in conformity with the guide.

Preferably, the structure further includes a rail case having the guides and the supporters formed therein opposite to each other, the rail case has a longitudinal slot in one side thereof, and the structure further includes one pair of the rail cases spaced from, and opposite to each other.

The setting means includes a release bar having a release cam at one end movable along the height adjusting paths and the release and setting paths, a shelf supporter fixed to the shelf, and an elastic member for supporting release bar and the shelf supporter, elastically.

Preferably, the rail case has a stopper for preventing the release cam from falling off the rail case.

The structure further includes one pair of the release bars spaced from, and opposite to, each other, and the structure further includes a release button connected between the other ends of the release bars to each other, and the release bar is movable relative to the shelf supporter in a state the release bar is inserted in the shelf supporter.

In another aspect of the present invention, a refrigerator includes a shelf height re-setting structure including one pair of rail cases mounted on an inside wall of a refrigerator body spaced from, and opposite to each other, each including one side of an inside of the rail case having guides projected and recessed repeatedly in a vertical direction each with a slope, and the other side of the inside of the rail case having supporters formed in conformity with the guides, and setting means fixed to the shelf so as to be movable along paths between the guides and the supporters for selecting a shelf height.

The supporter has a step at a top surface for setting a position of the setting means, and the refrigerator further includes an elastic member for providing restoring force to set the setting means at the step.

In another aspect of the present invention, a refrigerator includes a shelf height re-setting structure including a shelf mounted horizontally in a refrigerator so as to be movable in an up/down direction, a rail mounted to an inside wall of the refrigerator having sloped height adjusting paths and horizontal release and setting paths formed alternately and continuously, and setting means coupled to the shelf so as to be movable in a horizontal direction relative to the shelf for adjusting a shelf height step by step along the height adjusting paths, and setting an adjusted height at the release and setting paths.

In this case, the setting means includes a release cam movable along the height adjusting paths and the release and setting paths in the rail.

Advantageous Effects

The shelf height re-setting structure and the refrigerator having the same of the present invention have following advantageous effects.

First, fine adjustment of shelf height can be made conveniently without removal of food from the shelf.

Second, safe move down of the shelf can be made as much as desired without rapid move down by pressing a release button.

BRIEF DESCRIPTION OF THE DRAWINGS

The accompanying drawings, which are included to provide further understanding of the disclosure and are incorporated in and constitute a part of this application, illustrate embodiments of the disclosure and together with the description serve to explain the principle of the disclosure.

In the drawings.

MODE FOR THE INVENTION

Reference will now be made in detail to the specific embodiments of the present invention, examples of which are illustrated in the accompanying drawings. Wherever possible, the same reference numbers will be used throughout the drawings to refer to the same or like parts.

Figure 1:
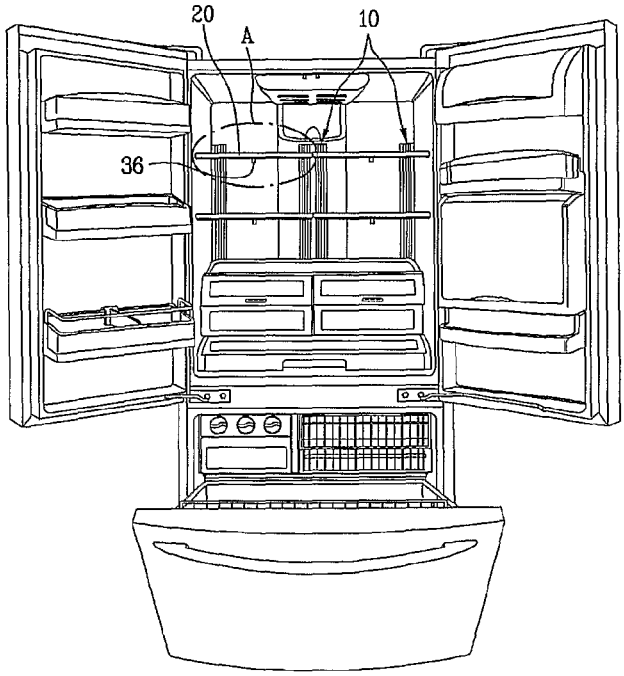
FIG. 1 illustrates a front view of a refrigerator having a shelf height re-setting structure in accordance with a preferred embodiment of the present invention applied thereto.
Figure 2:
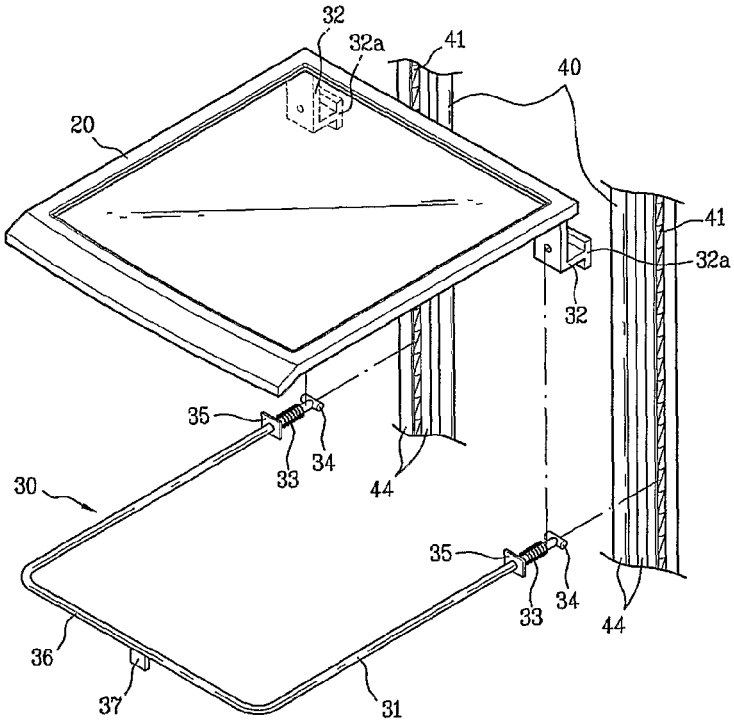
FIG. 2 illustrates an exploded perspective view of the shelf height re-setting structure A in FIG. 1.

Referring to FIGS. 1 and 2, the shelf height re-setting structure of the present invention includes rails 10 arranged on a rear wall of the refrigerator in a vertical direction spaced from one another, and setting means 30 mounted movable along the rails 10 in setting a height of the shelf 20.

Referring to FIG. 1, though one pair of the rails 10 are mounted to opposite edges of the rear wall, and another pair of the rails 10 are mounted adjacent to each other at a center of the rear wall, if the refrigerator has a small size, only the one pair of the rails 10 may be mounted to the opposite edges of the rear wall only.

Figure 3:
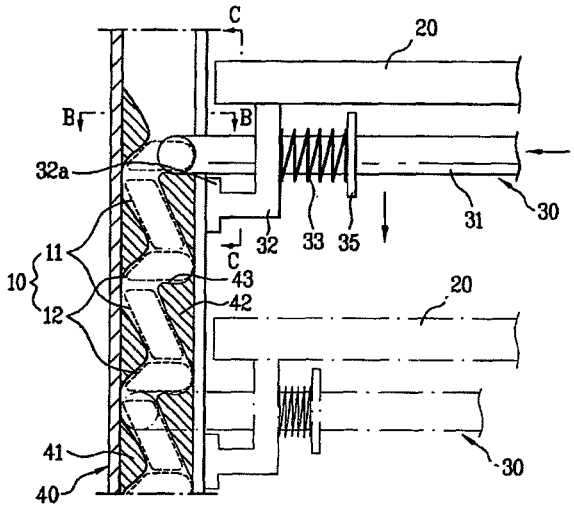
FIG. 3 illustrates a longitudinal section of the shelf height re-setting structure A in FIG. 2.
Figure 4:
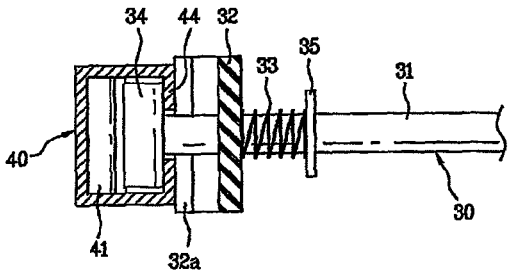
FIG. 4 illustrates a section across a B-B line in FIG. 3.
Figure 5:
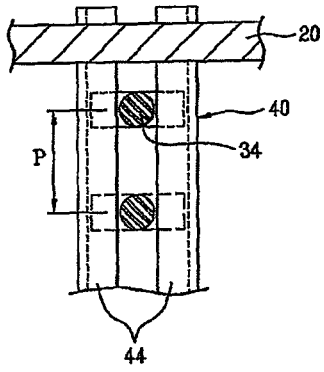
FIG. 5 illustrates a section across a C-C line in FIG. 3.
Figure 6:
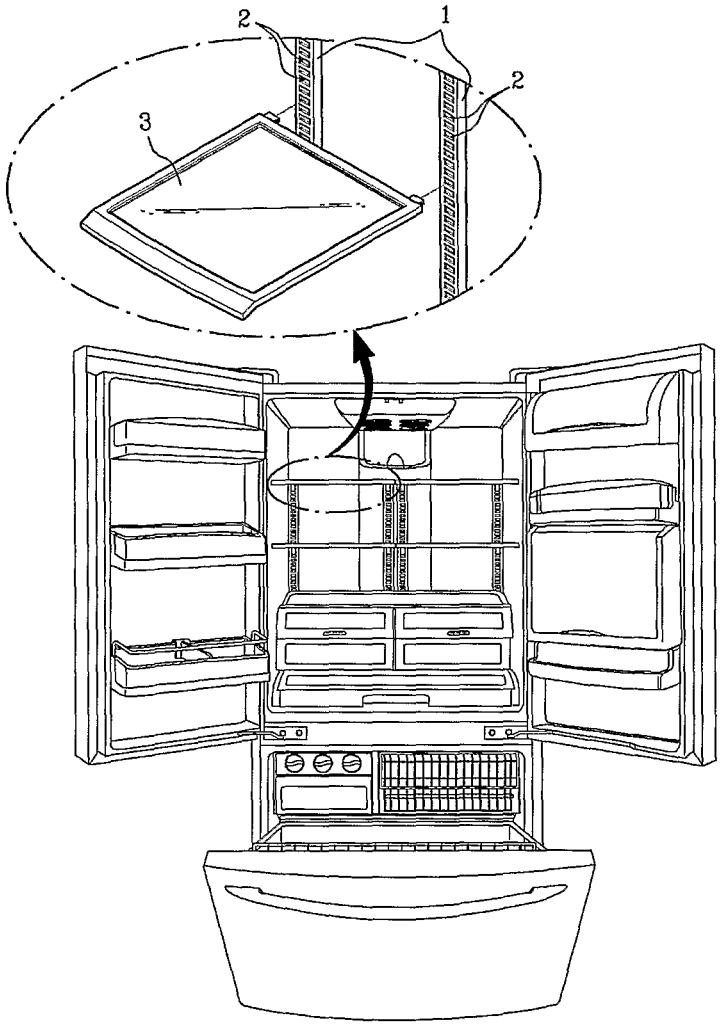
FIG. 6 illustrates a front view of a refrigerator having a related art shelf height re-setting structure applied thereto.
Figure 7:
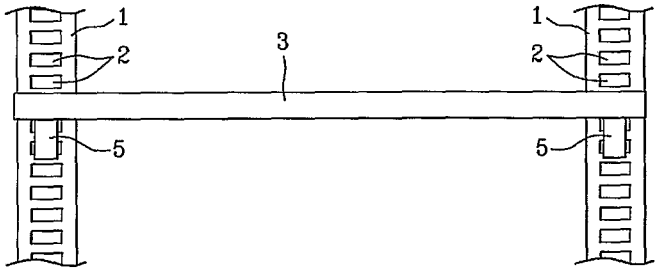
FIG. 7 illustrates a front view of the shelf height re-setting structure in FIG. 6.
Figure 8:
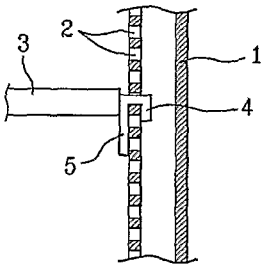
FIG. 8 illustrates a longitudinal section of the shelf height re-setting structure in FIG. 7.

Referring to FIGS. 3 to 5, each of the rails 10 has height adjusting paths 11 repeatedly formed therein in a vertical direction each with a slope, and release and setting paths 12 which connects the height adjusting paths 11 to each other.

Both the height adjusting paths 11 and the release and setting paths 12, paths for adjusting means 30 to move, are formed in a rail case 40 of a rectangular section having a vacant inside and one side with a longitudinal slot.

It is preferable that one pair or more than one pair of the rail cases 40 are mounted opposite to, and spaced from each other for supporting a load of the shelf 20 and secure smooth up/down movement of the shelf 20.

The height adjusting paths 11 are formed by guides 41 projected/recessed repeatedly from an inside wall of the one side of the rail case 40 in a zigzag shape to form a slope for smooth guidance of the adjusting means 30 in the vertical direction between adjacent supporters 42 to be described in detail, later. That is, the guides 41 form sloped stairs.

The release and setting paths 12 are formed by the supporters 42 projected from an inside wall of the other side of the rail case 40 toward the guides 41 for horizontal movement of the adjusting means 30 to release the adjusting means 30 from a set state, and to set the adjusting means 30 again, each between adjacent guides 41.

At the end, the height adjusting paths 11 guide slanted movement of the adjusting means 30 along the guides 41, and the release and setting paths 12 guide horizontal direction movement of the adjusting means 30 along the supporters 42 having top surfaces which form horizontal steps 43 projected repeatedly at regular intervals.

The adjusting means 30 is secured to an underside of the shelf 20 for moving along the release and setting paths 12 and the height adjusting paths 11 and selecting a height of the shelf 20 desired to set.

In detail, the adjusting means 30 includes a release bar 31, shelf supporters 32, and elastic members 33.

The release bar 31 moves back and forth relative to the shelf 20 fixed to the shelf supporters 32 in a state the release bar 31 is placed in the shelf supporter 32, and includes a release cam 34 at one end inserted in the inside space of the case 40 for moving along the height adjusting paths 11 and the release and setting paths 12.

That is, as a portion of the shelf 20, the shelf supporter 31 supports the release bar 31, and guides the release bar 31 depending on movement of the shelf 20.

Moreover, the shelf supporter 32 holds the release bar 31 as a portion of the shelf 20, and has a lower end extended such that the lower end is in contact with the inside wall of the refrigerator or an outside wall of a stopper 44 of the rail case 40 for the shelf to maintain a horizontal position.

A lower end portion 32*a* of the shelf supporter 32 can prevent the shelf 20 and the release bar 31 from tilting down by a weight.

In this instance, it is preferable that the shelf supporter 32 is fixed to an underside of the shelf 20, and the end of the release cam 34 has a smooth curve for smooth movement along the height adjusting paths 11 and the release and setting paths 12.

Accordingly, the guides 41 makes the release cam 34 to move along the guides 41 when a position of the release cam 34 is changed by the release bar 31, and to return to a setting position on the supporter 42.

The elastic member 33 has one end secured to the shelf supporter 32 and the other end secured to an elastic member securing portion 35 at the release bar 31 for elastic connection between the release bar 31 and the shelf supporter 32. A coil spring is shown as the elastic member in the drawing.

Especially, by always pulling the release bar 31 outwardly from the rail case 40, the elastic member 33 makes the release cam 34 to be forcibly set at the step 43 on the supporter 41 in the rail case 40. By this, the shelf 20 can be set at a particular height.

In this instance, for user's smooth handling of the back and forth movement of the release bar 31, a release button 36 may further provided for connecting opposite ends of the release bars 31. According to this, as shown in FIG. 2, the release bar 31 had a shape similar to an outline of the shelf 20 under the shelf 20.

Moreover, it is preferable that there is a pressing portion 37 at the middle of release button 36 for user's convenience of the release button 36 pressing at the time of the height re-setting of the shelf 20.

The rail case 40 has stoppers 44 on the opened one side projected to opposite sides for preventing the release cam 34 from tilling off the rail case 40 when the release cam 34 moves along the height adjusting paths 11 and the release and setting paths 12 in a state the release cam 34 is placed in the rail case 40.

In the meantime, though the shelf height re-setting structure of the present invention is described taking a twin door type refrigerator having a freezing chamber on a lower side as an example, the shelf height re-setting structure of the present invention is applicable, not only to a variety of modes of refrigerators, such as refrigerators having the freezing chambers on upper sides, but also to home appliances and/or office machines having shelves provided, essentially.

The operation of the shelf height re-setting structure of the present invention will be described in detail.

When the user intends to re-set the shelf 20 at a higher position, if the user holds and pushes up the shelf 20, the release cam 34 moves upward smoothly along the height adjusting paths 11 and the release and setting paths 12 guided by the guides 41 and the supporters 42.

Thus, the height change of the shelf 20 is possible by moving upward step by step along the height adjusting paths 11 and the release and setting paths 12, and at the moment force applied to the shelf 20 is removed, the release bar 31 moves back to an original position by restoring force of the elastic member 33, to secure the shelf 20 to the step 43 of the supporter 42. Thus, the shelf 20 can be moved up to a desired height and secured thereto.

Opposite to this, when the user intends to re-set the shelf 20 at a lower position, if the user applies force to the pressing portion 37 on the release button 36 to release a state the shelf 20 is secured to the supporter 42, the shelf 20 moves downward smoothly along the height adjusting paths 11 and the release and setting paths 12 guided by the guides 41 and the supporters 42.

In this instance, since the shelf 20 moves down only one step along the height adjusting paths 11 and the release and setting paths 12 and secured to the step 43 of the supporter 42, rapid move down of the shelf 20 is prevented, enabling step by step safe move down of the shelf only as much as the user intends to.

Moreover, because the release bar 31 is secured to the shelf supporter 32 fixed to the shelf 20 in a state the release bar 31 is inserted in the shelf supporter 32 such that the release bar 31 has elastic force applied thereto to restore the release bar 31 to the outside of the rail case 40 by the elastic member 33, the release cam 34 returns to the step 43 of the supporter 42 without application of external force, permitting convenient upward movement as well as safe downward movement.

It will be apparent to those skilled in the art that various modifications and variations can be made in the present invention without departing from the spirit or scope of the invention.

Thus, it is intended that the present invention cover the modifications and variations of this invention provided they come within the scope of the appended claims and their equivalents.

The invention claimed is:

1. A shelf height re-setting structure comprising:

a shelf;

a rail having guides formed on a first surface, each guide having a projection and a recess to form a slope and supporters formed on a second surface opposite the first surface, each supporter having a step at a top surface for setting a position of the shelf, the guides and the supporters defining therebetween height adjusting paths repeated in a vertical direction and release and setting paths connected between adjacent height adjusting paths, and the release and setting paths facing the height adjusting paths; and setting means secured to the shelf so as to be movable along the height adjusting paths and release and setting paths for selecting a height of the shelf, the setting means comprising:

a push bar having a release cam at one end, the release cam having a smoothly curved surface so as to move along the height adjusting paths and the release and setting paths;

a shelf supporter fixed to the shelf; and an elastic member for supporting the push bar and the shelf supporter elastically, wherein the shelf remains perpendicular to the rail while traversing multiple height adjusting paths.

2. The structure as claimed in claim 1, wherein the release and setting paths are horizontal.

3. The structure as claimed in claim 1, wherein the elastic member provides restoring force for securing the release cam to the supporter.

4. The structure as claimed in claim 1, wherein the steps of the supporters have top surfaces projected horizontally at regular intervals.

5. The structure as claimed in claim 4, wherein the supporter is sloped starting from the top surface to a lower side in conformity with the guide.

6. The structure as claimed in claim 1, wherein the rail is a rail case having the guides and the supporters formed therein opposite to each other.

7. The structure as claimed in claim 6, wherein the rail case has a longitudinal slot in one side thereof.

8. The structure as claimed in claim 6, further comprising one pair of the rail cases spaced from, and opposite to, each other.

9. The structure as claimed in claim 1, wherein the rail is a rail case having the first surface and the second surface, and wherein the rail case has a stopper for preventing the release cam from falling off the rail case.

10. The structure as claimed in claim 1, further comprising one pair of the push bars spaced from, and opposite to, each other.

11. The structure as claimed in claim 10, further comprising a release button connected between the other ends of the push bars.

12. The structure as claimed in claim 1, wherein the push bar is movable relative to the shelf supporter in a state the push bar is inserted in the shelf supporter.

13. A refrigerator comprising:

a shelf height re-setting structure, the structure comprising:

one pair of rail cases mounted on an inside wall of a refrigerator body spaced from, and opposite to, each other, each rail case having guides projected and recessed repeatedly in a vertical direction on one inside surface of the rail case, each guide having a slope, and each rail case having supporters formed in conformity with the guides on the other inside surface of the rail case opposite the guides and facing the guides, each supporter having a step at a top surface for setting a position of the shelf; and setting means fixed to the shelf so as to be movable along paths between the guides and the supporters for selecting a shelf height, the setting means comprising:

a push bar having a release cam at one end, the release cam having a smoothly curved surface so as to move along the height adjusting paths and the release and setting paths;

a shelf supporter fixed to the shelf; and an elastic member for supporting the push bar and the shelf supporter elastically, wherein the top surface of each step is provided to set a position of the release cam, and wherein the shelf remains horizontal as it moves along multiple paths between the guides and the supporters.

14. The refrigerator as claimed in claim 13, wherein the elastic member provides restoring force for securing the release cam at the step.

15. The refrigerator as claimed in claim 13, wherein the rail case comprises a longitudinal slot at one side for guiding movement of the push bar.

16. The refrigerator as claimed in claim 13, wherein the rail case comprises a stopper for preventing the release cam from falling off the rail case.

17. The refrigerator as claimed in claim 13, further comprising one pair of the push bars spaced from, and opposite to, each other and a release button connected between the other ends of the push bars.

18. The refrigerator as claimed in claim 13, wherein the push bar is movable relative to the shelf supporter in a state the push bar is inserted in the shelf supporter.

19. A refrigerator comprising:

a shelf height re-setting structure, the structure comprising:

a shelf mounted horizontally in the refrigerator so as to be movable in an up/down direction;

a rail mounted to an inside wall of the refrigerator, the rail having a first surface adjacent the inside wall and a second surface spaced from the inside wall opposite the first surface, the rail having guides formed on the first surface, each guide having a projection and a recess to form the slope and supporters formed on the second surface, each supporter having a step at a top surface for setting a position of the shelf, the guides and supporters defining therebetween sloped height adjusting paths and horizontal release and setting paths formed alternately to the sloped height adjusting paths, the sloped height adjusting paths and the horizontal release and setting paths formed continuously between the first and second surfaces; and setting means coupled to the shelf so as to be movable in a horizontal direction relative to the shelf for adjusting a shelf height step by step along the height adjusting paths, and setting an adjusted height at the release and setting paths, the setting means comprising:

a push bar having a release cam at one end, the release cam having a smoothly curved surface so as to move along the height adjusting paths and the release and setting paths in the rail;

a shelf supporter fixed to the shelf; and an elastic member for supporting the push bar and the shelf supporter elastically, wherein the shelf remains perpendicular to the rail while traversing multiple height adjusting paths.

* * * * *